US006076494A

United States Patent [19]

Kampichler et al.

[11] Patent Number: 6,076,494

[45] Date of Patent: Jun. 20, 2000

[54] INTERNAL COMBUSTION ENGINE AND METHOD FOR MANUFACTURING SAME

[75] Inventors: Guenter Kampichler, Ruhstorf; Erich Eder, Vornbach, both of Germany

[73] Assignee: Motorenfabrik Hatz GmbH & Co. KG, Ruhstorf/Rott, Germany

[21] Appl. No.: 09/125,304

[22] PCT Filed: Dec. 11, 1997

[86] PCT No.: PCT/EP97/06914

§ 371 Date: Aug. 13, 1998

§ 102(e) Date: Aug. 13, 1998

[87] PCT Pub. No.: WO98/26171

PCT Pub. Date: Jun. 18, 1998

[30] Foreign Application Priority Data

Dec. 13, 1996 [DE] Germany ..... 196 52 049

[51] Int. Cl.[7] ..... F02F 7/00

[52] U.S. Cl. ..... 123/195 R; 123/193.3

[58] Field of Search ..... 123/195 R, 193.3, 123/195 A, 195 C, 41.17, 41.44

[56] References Cited

U.S. PATENT DOCUMENTS

| | | | |
|---|---|---|---|
| 2,491,630 | 12/1949 | Voorhies | 121/194 |
| 4,699,100 | 10/1987 | Leydorf, Jr. et al. | 123/193 CH |
| 4,759,317 | 7/1988 | Ampferer | 123/41.74 |
| 4,763,619 | 8/1988 | Eitel . | |
| 5,429,080 | 7/1995 | Pong . | |

FOREIGN PATENT DOCUMENTS

| | | |
|---|---|---|
| 1233016 | 4/1959 | France . |
| 1228437 | 3/1960 | France . |
| 841526 | 6/1952 | Germany . |
| 1993272 | 9/1968 | Germany . |
| 2718162 | 11/1978 | Germany . |
| 660525 | 11/1951 | United Kingdom . |
| 1565799 | 4/1980 | United Kingdom . |
| 2150635 | 7/1985 | United Kingdom . |

*Primary Examiner*—Henry C. Yuen
*Assistant Examiner*—Mahmoud W. Gimie
*Attorney, Agent, or Firm*—Helfgott & Karas, PC.

[57] ABSTRACT

In an internal combustion engine, especially a multi-cylinder four-stroke diesel engine with split cast crankcase comprising two half-shells (1*a*, 1*b*) clamped together by fastening studs, with the joint plane running in the direction of the crankshaft and cylinder axis, there are disposed, in recesses provided therefor in the half shells (1*a*, 1*b*), separate cylinder sleeves (2), each closed at its top end by a separate cylinder cover (10) with a circumferential rim. These cylinder covers (10) are completely clamped sealingly between the crankcase half shells (1*a*, 1*b*). A method for making such an internal combustion engine is also described.

8 Claims, 6 Drawing Sheets

INTERNAL COMBUSTION ENGINE AND METHOD FOR MANUFACTURING SAME

FIELD OF THE INVENTION

Internal combustion engine and method for manufacturing same The present invention relates to an internal combustion engine, especially a multi-cylinder four-stroke diesel engine with split cast crankcase comprising two half-shells clamped together by fastening studs, with the joint plane running in the direction of the crankshaft and cylinder axis, and to a method for making same.

BACKGROUND OF THE INVENTION

Such internal combustion engines are described in the prior art.

For example, DE 2718162 A1 describes an air-cooled one-cylinder two-stroke internal combustion engine comprising one cylinder with at least exhaust and overflow ducts, a two-piece crankcase and a crankshaft held in its bearing in the crankcase. This crankcase is split in the longitudinal direction of the cylinders to above the top edge of the exhaust duct. The joint plane runs through the crankshaft bearing and through the cylinder axis. The cylinder and cylinder head are made as a one-piece die-casting; cooling fins are formed on the cylinder head above the cylinder.

Furthermore, U.S. Pat. No. 4,763,619 discloses a multi-cylinder internal combustion engine with a split engine block of cast construction in which the joint plane runs through the crankshaft bearing and the cylinder axes. The two engine halves are joined by studs passed through the entire crankcase. The cylinder sleeves are made together with a cylinder head as a one-piece die-casting and are joined interlockingly with the engine halves by a clamping device. Coolant flows through the intermediate space between engine block and cylinder sleeves.

In both cited prior-art internal combustion machines, the cylinder heads cast in one piece together with the cylinder sleeves form a complex casting, which can be made only with great expense by using cores. In addition, the cylinder heads must be particularly stable, since they extend well beyond the crankcase. A further disadvantage of the one-piece construction is that the entire component comprising cylinder sleeves and cylinder head must be replaced if repairs are needed, even if only one sleeve or one part of the cylinder head is damaged.

Finally, it is known (German Utility Model 1993272) that a watercooled one-cylinder two-stroke engine can be assembled from two crankcase halves split in the direction of the crankshaft axis, each being made as a one-piece casting. Thus the cylinder head is already formed at the same time, and so certain requirements must be imposed on the production of the cast shape. A suggestion on how to cast a multi-cylinder internal combustion engine cannot be inferred from the document.

U.S. Pat. No. 5,429,080 describes an internal combustion engine in which two crankcase halves, in each of which there is inserted a cylinder sleeve and a cylinder cover, are joined together. The said cylinder covers are provided with valve guides and inlet and exhaust ducts, and project beyond the top part of the crankcase. In that invention the joint plane of the crankcase halves runs parallel to the direction of the cylinder axis and perpendicular to the crankshaft axis, leading in the case of a multi-cylinder internal combustion engine to a plurality of partial half-shells, each assembled as one-cylinder modules, which in turn are assembled as an engine block, whereby the gaskets are correspondingly very complex. The cylinder covers projecting beyond the crankcase require a correspondingly massive construction for strength reasons.

SUMMARY OF THE INVENTION

The object of the present invention is to provide a compact multi-cylinder internal combustion engine that can be made inexpensively from few castings, is simple to manufacture and in addition is easy to maintain and repair.

This object is achieved by a multi-cylinder internal combustion engine and by a method for making the same by die casting.

An internal combustion machine according to the invention has, as inserts in recesses provided therefor in the cast half shells, separate cylinder sleeves, each of which is tightly closed at its top end by a separate cylinder cover equipped with a circumferential rim or collar, the cylinder covers being completely clamped between the half shells, forming a seal with their rim which, for example, closes off the top edge of the crankcase. By virtue of the structural design of the crankcase half shells, there is achieved a small mold depth, and the internal combustion machine according to the invention can thereby be made inexpensively from two crankcase halves, for example of light metal, in the die-casting process. When aluminum is used as cast material, a compact internal combustion engine with a weight reduction of as much as 30% compared with engines made from gray cast iron is achieved. Furthermore, the fact that parts projecting beyond the crankcase contour are not needed also contributes to the compact structure. The use of separate cylinder sleeves and cylinder covers promotes inexpensive manufacture and simple assembly. Furthermore, the advantage is obtained herefrom that each cylinder cover can be easily replaced individually, for example if the valve seat becomes damaged. This concept therefore has considerable advantages compared with the usual solid-block cylinder heads of liquid-cooled engines. The cylinder sleeves, which rarely need to be replaced, are readily accessible by removing one shell half. Cylinder sleeves and cylinder covers are set in the crankcase in such a way that only the valve stems and the stem of the injection device project beyond the crankcase half shells. Hereby the danger of damage to the cylinder sleeves or cylinder cover by external influences is advantageously minimized. The cylinder sleeves can be made, for example, of gray cast iron in the centrifugal casting process or of AlSi material by spray compaction.

In an advantageous further embodiment of the present invention, the cylinder covers each has an inlet and exhaust valve as well as an injection device. In this way the necessary passages and ports can be made either by subsequent metal-cutting operations or directly during casting.

Furthermore, an advantageous embodiment provides that the covers each have an inlet and exhaust port in their rim region. The lateral positioning of the inlet and exhaust ports ensures that the cylinder covers form a complete compact structural assembly with valves, valve seats and inlet and exhaust ducts, the inlet and exhaust ports being attached sealingly to corresponding crankcase parts during assembly and the cylinder cover being seated sealingly on the cylinder sleeve.

It is further provided that inlet and exhaust ducts pass laterally through each half shell. Thereby the inlet and exhaust-gas connections are attached in simple manner to lateral flanges on the outsides of the crankcase half shells.

In an advantageous embodiment, the internal combustion engine is provided with lubricant and coolant ducts in the crankcase halves, so as to ensure adequate cooling and lubrication during operation. The coolant can then be water, oil or any other fluid suitable for cooling.

An advantageous further embodiment provides that the ducts for lubricant and/or coolant supply are formed by one or more prefabricated tube systems, each cast in the two half shells. This contributes advantageously to streamlined manufacture of the engine crankcase, since it obviates the need for time-consuming and expensive subsequent machining of the castings by boring of coolant and lubricant ducts, as would otherwise be customary.

An advantageous method for making, by the die-casting process, a two-piece engine crankcase split in the direction of the crankshaft for a multi-cylinder internal combustion engine comprises the following process steps:

construction of tube systems to form the ducts for gas flow as well as lubricant and coolant supply in the crankcase sections, placing of the tube systems in the die-casting molds for the crankcase sections, casting of the crankcase sections with tube systems embedded therein in order to form crankcase half shells (1*a*, 1*b*) of the engine crankcase.

In the present manufacturing method, the casting process is simplified by the fact that the mold-release depth of the two cast shells is considerably smaller than in the case of standard gray cast iron crankcases. By virtue of the incorporation of prefabricated tube systems in the die-casting mold, additional subsequent machining is no longer necessary, since the need to make ducts for lubricant and/or coolant supply by metal-cutting processes is largely obviated. Furthermore, the tubes can act as tie rods to distribute ignition pressures and to provide frictional binding to the main bearing. An advantageous casting process is aluminum die-casting. Since the joint plane is disposed in the direction of the crankshaft and cylinder axis, a multi-cylinder engine can be made in simple manner from two flat half shells. Since the tube system is cast into the half shells of the crankcase or internal combustion engine frame halves, a static lattice is produced by the combination of the two halves, and so only little aluminum has to be cast therearound as filler to withstand the dynamic forces. The cylinder sleeves are preferably made as gray cast iron sleeves by the centrifugal casting process. However, the use of ceramic cylinder sleeves is also possible. The cylinder covers expediently have the form of circular disks. In addition to the inlet and exhaust ducts as well as valve seats and tappet springs, they have a port for the injection device and quick-start glow plug. The cylinder covers can be inserted in already preassembled form between the half shells. The same applies to the crankshaft, which together with the connecting rods and pistons mounted thereon and the cylinder sleeves and associated gaskets placed thereover is inserted in one half shell and held in its bearing by cooperation with the other half shell. For this purpose the two half shells are clamped together by studs running transversely through the engine crankcase. The tension rods for clamping the two half shells with each other are then advantageously screwed into cast-in tubes, the remaining annulus being usable for the compressed oil supply. In this way inexpensive manufacture is possible and maintenance is additionally facilitated by the fact that access to the internals of the engine is possible simply by swinging open one crankcase half.

BRIEF DESCRIPTION OF THE DRAWINGS

The present invention will be described hereinafter on the basis of a practical example with reference to the appended drawings, wherein.

DETAILED DESCRIPTION OF THE INVENTION

Figure 1:
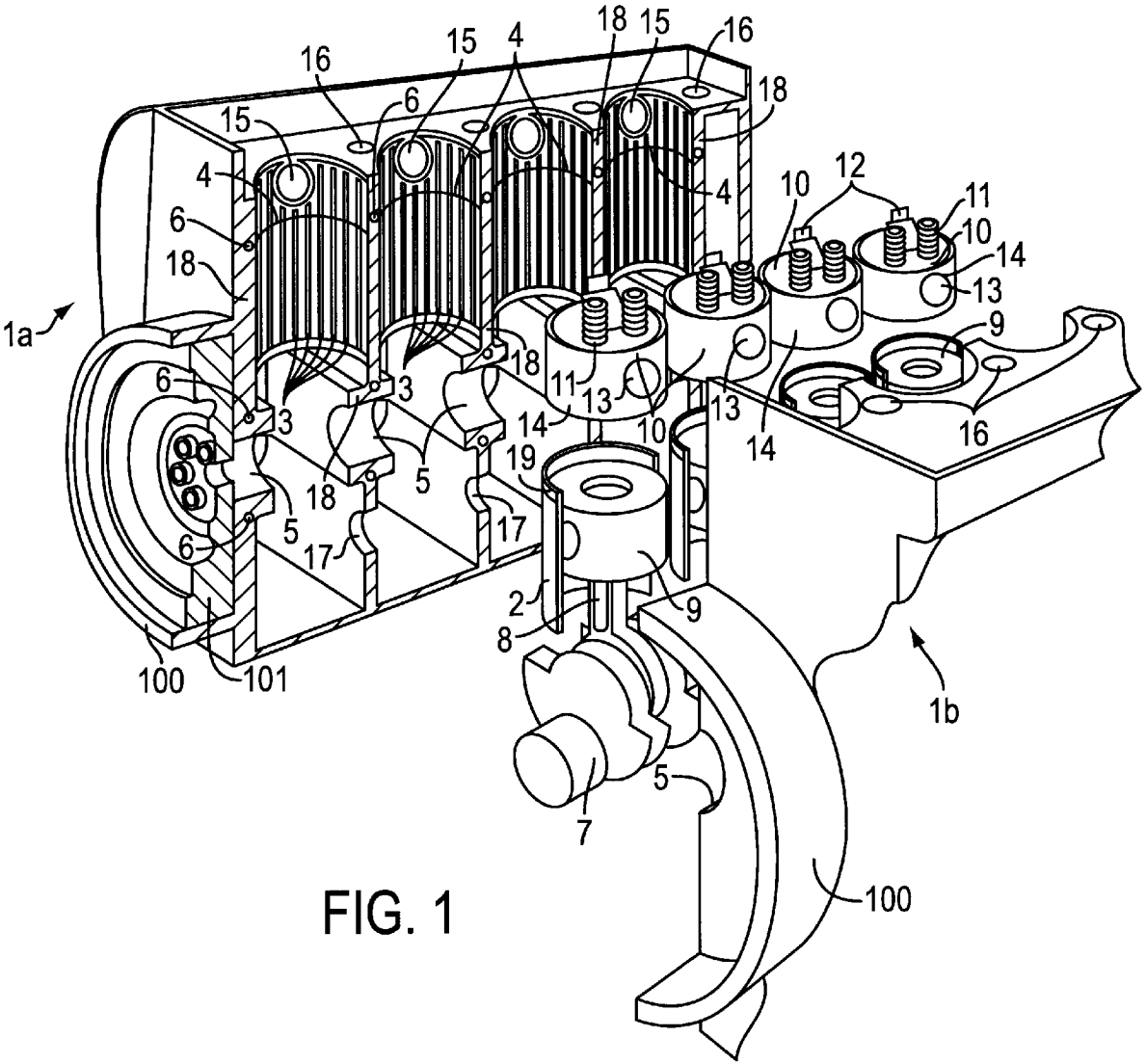
FIG. 1 shows an exploded drawing of a multi-cylinder four-stroke engine according to the invention.

FIG. 1 shows a schematic exploded drawing of a four-cylinder engine according to the invention. It has two light-metal crankcase halves 1*a*, 1*b*, the joint plane of which extends in assembled condition along the crankshaft axis as well as the cylinder axes. The recesses in the crankcase halves 1*a*, 1*b* for accommodating the cylinder sleeves 2 are provided with support ribs 3, between which coolant flows. Furthermore, the cavities for accommodating the cylinder sleeves 2 have shoulders 4 running perpendicular to the cylinder axis. The shoulders 4 are used to accommodate the sleeve collar 19 of the cylinder sleeve 2 in the assembled condition. Moreover,4 the split bearing seats 5 for accommodating the crankshaft bearing are illustrated in the crankcase half shells 1*a*, 1*b*. In addition, the passages 6 for the tension rods for clamping the half shells are illustrated in the crankcase webs 18, on which the bearing seats 5 are formed.

Furthermore, through holes 17 between the individual cylinder chambers are disposed on the crankcase webs 18. Replacement of lubricant oil as well as crankcase ventilation takes place via these holes. The crankshaft 7 with connecting rods 8 and pistons 9 is shown between the two crankcase half shells 1*a*, 1*b*. Furthermore, the cylinder covers 10 with the valve tappet springs 11 and the injection nozzles 12 as well as the inlet/exhaust ports 13 are shown between the crankcase half shells 1*a*, 1*b*. The cylinder covers 10 have a cylindrical rim 14, which is wide enough to extend over the inlet and exhaust port 13 and is completely accommodated by the crankcase halves 1*a*, 1*b* and squeezed during clamping. Ducts 15 in the crankcase half shells are allocated to the inlet and exhaust ports 13 of the cylinder covers 10. Ports 16 for the lubricant ducts are disposed on the top sides of each of the crankcase half shells. These are also used as screw-down points for the camshaft bearing, which is also used for clamping the cylinder covers 10. The flywheel case 100 as well as the flywheel 101 is disposed at the front end of the crankcase. Sealing of the two crankcase halves 1*a*, 1*b* is achieved by clamping to impose metal-to-metal contact or by bonding the two crankcase halves by means of flat gasket material and then clamping them together.

Figure 2:
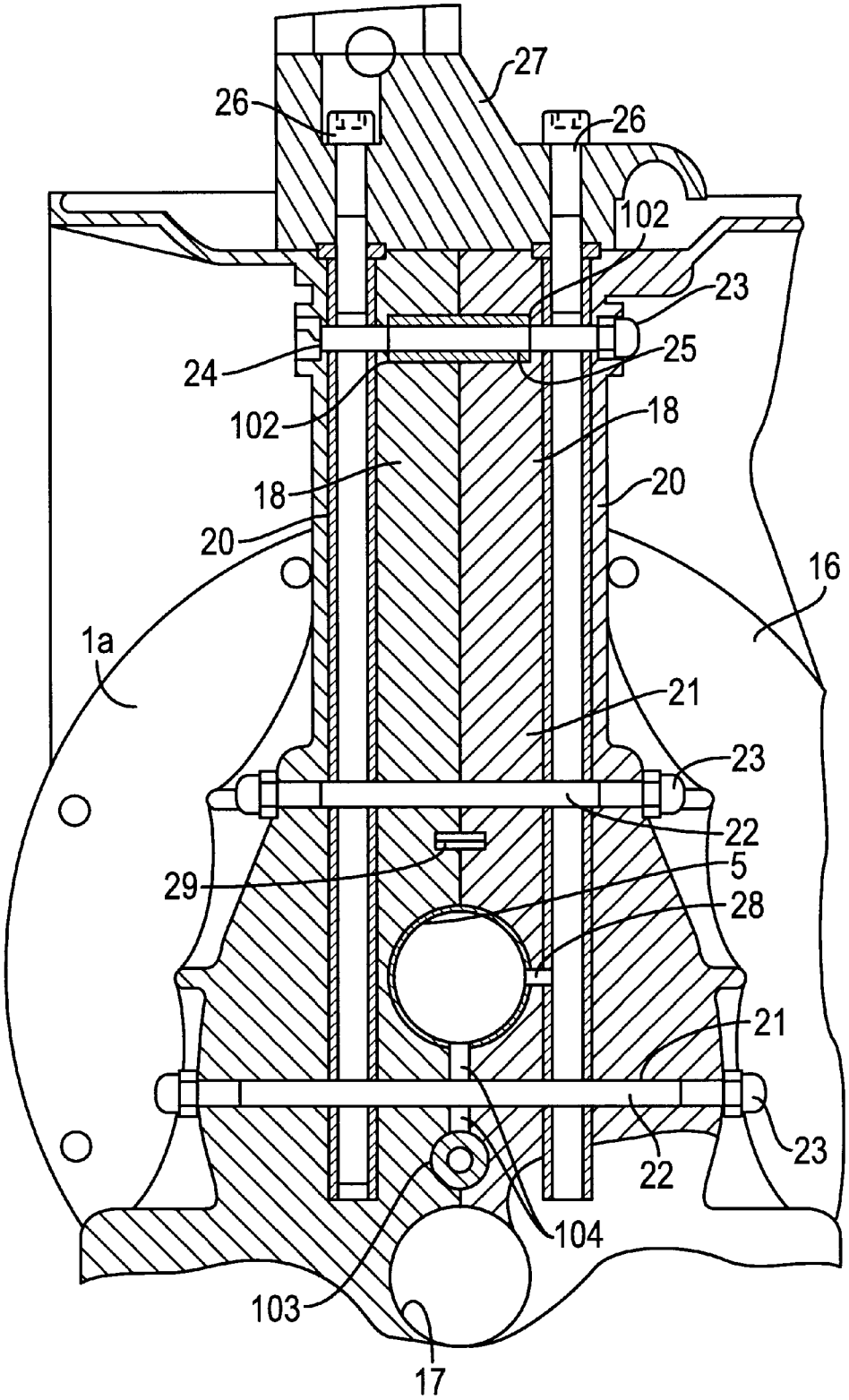
FIG. 2 shows the arrangement of lubricant ducts as well as studs for clamping the two crankcase halves together.

FIG. 2 shows a cross section through an engine crankcase at the height of a crankcase web 18 of the two crankcase halves 1*a*, 1*b*. Evident therein are the cast-in tubes 20 for lubricant supply to the engine parts disposed at the top. The tubes are supplied from bearings 5, which run parallel to the joint plane and are inlaid in the mold of the crankcase halves during the casting process. The bearings 5 are supplied by an oil-supply line 103 that is clamped in place and that itself is disposed directly downstream from the oil pump and oil filter. The line 103 lies above the ventilation through hole 17 and communicates with bearing 5 via line 104. Perpendicular to the joint plane there run bores 21, which accommodate tension rods 22, which are screwed down by means of nuts 23. In the region of the cylinder covers, the crankcase halves 1*a*, 1*b* are screwed together by means of a cylinder stud 24 and a nut 23. This carries a bush 25 and on both sides an O-ring 102 to ensure sealing, since the screwed coupling passes through the coolant jacket. On the top side of each crankcase half 1*a*, 1*b* there are secured, by means of tensile bolts 26, the camshaft bearing brackets 27, which are also used for clamping the cylinder covers. For this purpose the bolts 26 are screwed into the female thread of the tubes 20. The tubes 20 are also used to convey oil upward to the cylinder covers and camshaft bearings. The tubes 20 are supplied via the connecting bores 28 with compressed oil from the bearings 5. Also evident in FIG. 2 are the centering pin 29 and the ventilation through hole 17. The latter is used for communication with the cylinder chambers and provides for venting of the chambers. The level in the oil pan is higher than the bottom edge of the through hole 17.

Figure 3:
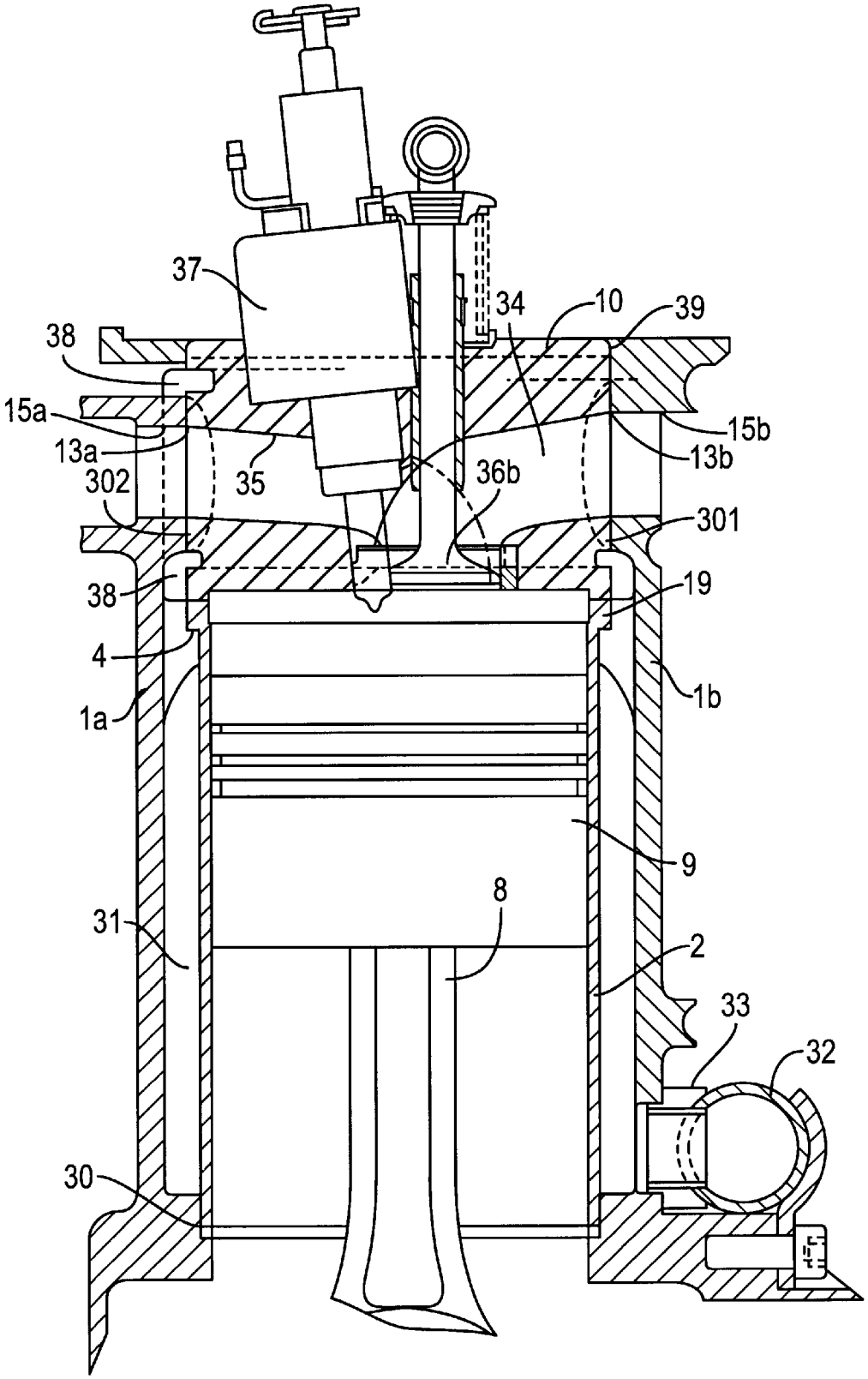
FIG. 3 shows a section through a cylinder according to the invention transverse to the joint plane of the engine.

FIG. 3 shows a section through a cylinder according to the present invention. Therein there can be seen the piston 9 together with connecting rod 8 disposed in the cylinder sleeve 2. The cylinder sleeve 2 is clamped between the crankcase half shells 1*a*, 1*b* and in the middle region is supported on the support ribs. It is sealed in its lower region by a ring seal 30. Between the support ribs and the crankcase there are disposed cavities 31, through which coolant flows, for cooling the cylinder sleeves. For this purpose the coolant is supplied via tube 32 and bush 33 and removed via duct 38. At its top end the cylinder sleeve 2 is provided with a circumferential sleeve collar 19, which is seated on the shoulder 4. The top end of the cylinder sleeve 2 is covered by the cylinder cover 10, which is clamped sealingly against the cylinder sleeve 2. In the cylinder cover 10, which is also made as a casting, there are provided the inlet duct 35 and exhaust duct 34, the position of the valve seat of the inlet valve being indicated merely by a broken line, since it is located in front of the section plane. The injection device (pump nozzle) 37 is disposed between the inlet and exhaust valves 36*a*, 36*b*. Coolant from the ducts 38 also flows all around the cylinder cover which, in its upper region, is sealed by gasket 39 as well as by gaskets 301 and 302 at the inlet and exhaust ports 13*a*, 13*b*.

Figure 4:
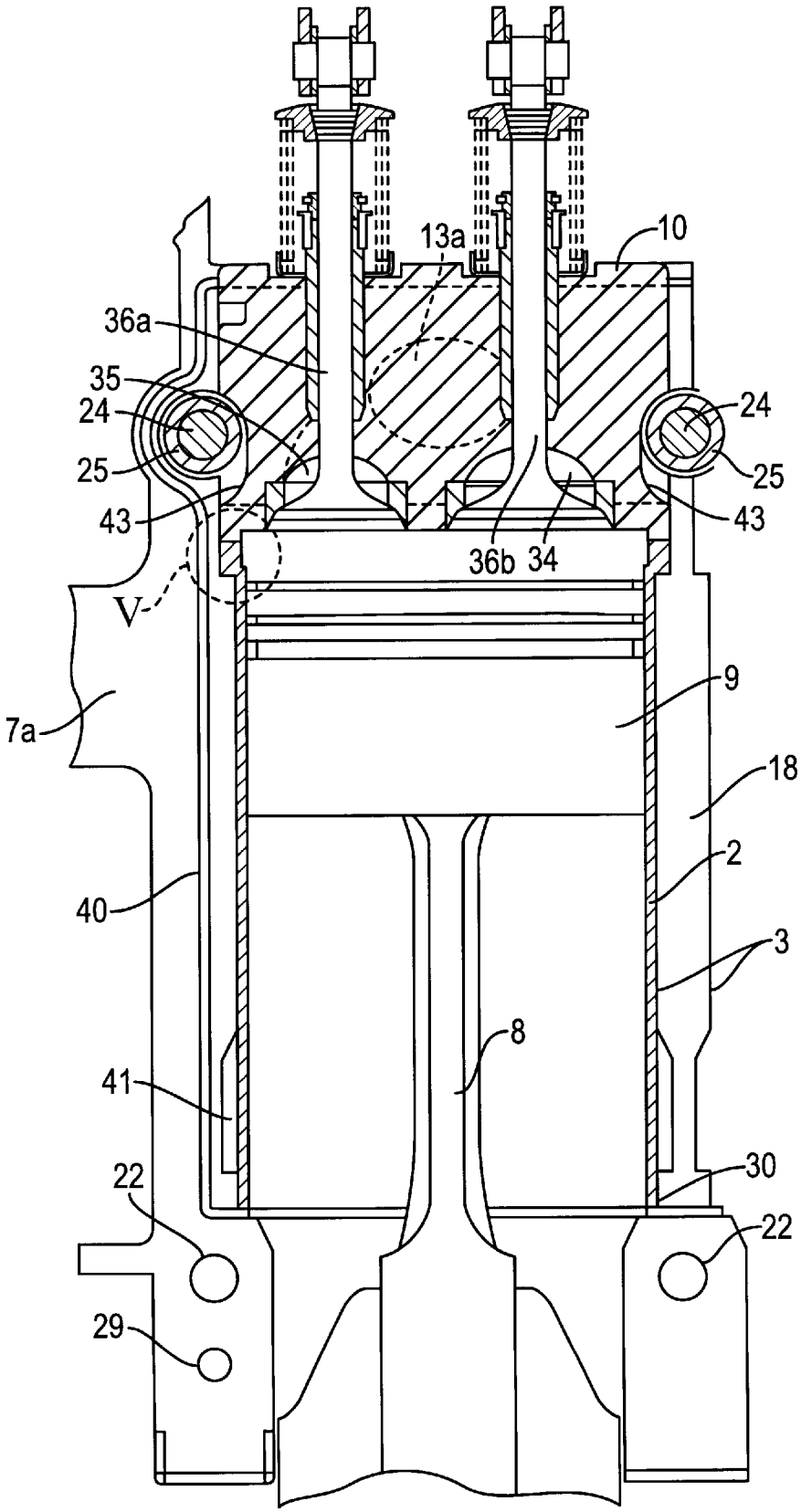
FIG. 4 shows a section through a cylinder parallel to the joint plane of the engine.

FIG. 4 shows a further section through the cylinder in the direction of the joint plane. Besides the cylinder sleeve 2, the piston 9 and the connecting rod 8 as well as the tension studs 24 and 22, there are illustrated the centering stud 29 and sealing ring 30. In addition, a cord seal 40 is positioned between the two crankcase halves. The support ribs 3, which impart lateral stability to the cylinder sleeve 2, project from the crankcase webs 18. Below the support ribs 3 there is provided a recess 41 through which coolant flows. The cylinder cover 10 is disposed above the cylinder sleeve 2 and clamped sealingly together therewith. The valves 36*a*, 36*b* are in communication with exhaust and inlet ducts 34, 35, the inlet port 13*a* being indicated by a broken line. The bushes 25 and O-rings 102 surrounding the cylinder stud 24 provide sealing between coolant space and oil-conveying space in the cast-in tubes 20. The cylinder cover 10 is provided with lateral recesses 43, which partly accommodate the bushes 25 and O-rings 102.

Figure 5:
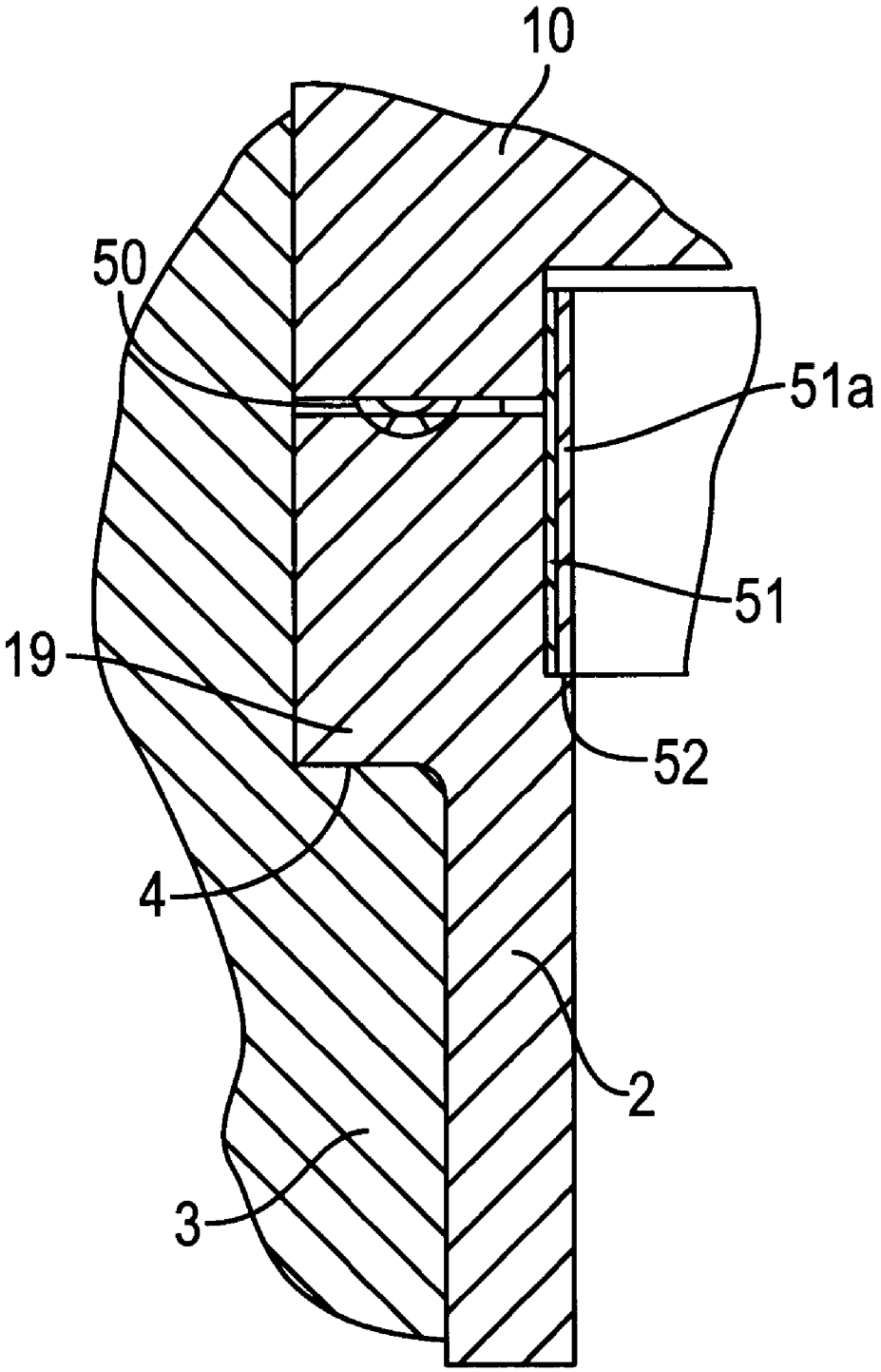
FIG. 5 shows detail V from FIG. 4.

FIG. 5 shows detail V from FIG. 4, which represents the transition from the cylinder sleeve 2 to the cylinder cover 10, a support rib 3 together with shoulder 4 as well as sleeve collar 19 of the cylinder sleeve 2 being illustrated. The path of force proceeds from the camshaft bearing via the cylinder head cover 10 into the cylinder sleeve 2 via the sleeve collar 19 into the shoulder 4 and into the crankcase web. Between cylinder cover 10 and cylinder sleeve 2 there is provided a metal ring seal 50 for water and gas sealing, while two sheet-metal bands 51 and 51*a* cut flush and twisted against each other are inlaid as additional combustion-gas sealing. The sheet-metal bands 51 and 51*a* are held in place by a sleeve collar 52 of the cylinder sleeve 2. The bands are forced against the wall under the effect of compression and ignition pressure and seal the gaps against combustion gases.

Figure 6:
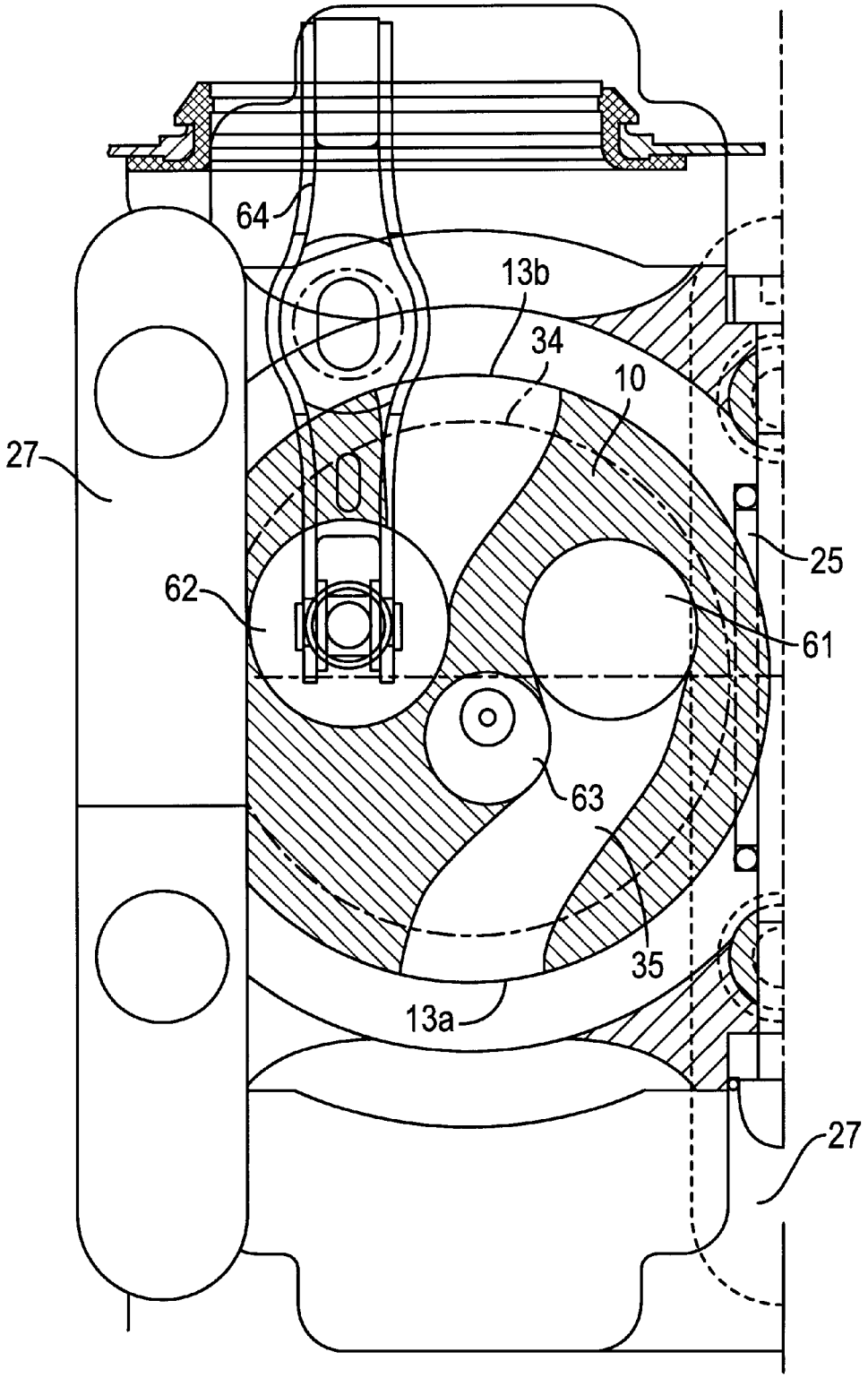
FIG. 6 shows a partly cut away overhead view of a cylinder.

FIG. 6 shows an overhead view of a cylinder with a cylinder cover 10, cut away at the height of the exhaust and inlet ducts 34, 35. The port 63 for the injection valve is shown between the valve ports 61, 62. In addition, the camshaft bearing brackets 27 used to clamp the cylinder cover as well as the bushes 25 are shown as broken lines, since they are located in other planes. Finally, the rocker 64 for valve operation is also indicated as a broken line.

What is claimed is:

1. A multi-cylinder internal combustion engine, especially as a four-stroke diesel engine, with split cast crankcase comprising two half-shells (1*a*, 1*b*) clamped together by fastening studs (22, 24), with the joint plane running in the direction of the crankshaft and cylinder axis, characterized in that separate cylinder sleeves (2) are disposed in recesses provided in the half shells (1*a*, 1*b*), and in that the recesses are closed at their top ends by separate cylinder covers (10), each provided with a circumferential rim (14) with which they are clamped sealingly at least partly between the crankcase half shells (1*a*, 1*b*).

2. An internal combustion engine according to claim 1, characterized in that each cylinder cover (10) is clamped substantially completely between the crankcase half shells (1*a*, 1*b*).

3. An internal combustion engine according to claim 1, characterized in that the cylinder covers (10) are each equipped with an inlet and an exhaust valve (36*a*, 36*b*) as well as an injection device (37).

4. An internal combustion engine according to claim 1, characterized in that the cylinder covers (10) each have an inlet port (13*a*) and an exhaust port (13*b*) in their rim region.

5. An internal combustion engine according to claim 1, characterized in that ducts (15*a*, 15*b*) to the inlet and exhaust ports (13*a*, 13*b*) are provided laterally through each crankcase half shell (1*a*, 1*b*).

6. An internal combustion engine according to claim 1, characterized in that the crankcase half shells (1*a*, 1*b*) contain ducts (20) for the lubricant and/or coolant supply (31, 38, 41).

7. An internal combustion engine according to claim 1, characterized in that the crankcase half shells (1*a*, 1*b*) contain ducts (31, 38, 41) for water cooling.

8. An internal combustion engine according to claim 6, characterized in that the ducts (20) for lubricant and/or coolant supply are formed by one or more prefabricated tube systems cast into each half shell (1*a*, 1*b*).

* * * * *

UNITED STATES PATENT AND TRADEMARK OFFICE

CERTIFICATE OF CORRECTION

PATENT NO. : 6,076,494
DATED : June 20, 2000
INVENTOR(S) : Guenter Kampichler, et al.

It is certified that error appears in the above-identified patent and that said Letters Patent is hereby corrected as shown below:

Please replace Drawings for "Figure 2 and Figure 3" (Sheet 2 of 6 and 3 of 6) with the attached Corrected Drawings of "Figure 2 and Figure 3".

Signed and Sealed this

Thirty-first Day of July, 2001

*Attest:*

Nicholas P. Godici

*Attesting Officer*

NICHOLAS P. GODICI
*Acting Director of the United States Patent and Trademark Office*